US007156182B2

(12) United States Patent
Lynde et al.

(10) Patent No.: US 7,156,182 B2
(45) Date of Patent: Jan. 2, 2007

(54) METHOD AND APPARATUS FOR ONE TRIP TUBULAR EXPANSION

(75) Inventors: Gerald D. Lynde, Houston, TX (US); John L. Baugh, Houston, TX (US); Leopoldo S. Gomez, Houston, TX (US); John P. Davis, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 197 days.

(21) Appl. No.: 10/382,390

(22) Filed: Mar. 6, 2003

(65) Prior Publication Data

US 2003/0196818 A1 Oct. 23, 2003

Related U.S. Application Data

(60) Provisional application No. 60/362,306, filed on Mar. 7, 2002.

(51) Int. Cl.
*E21B 43/10* (2006.01)
*E21B 23/00* (2006.01)

(52) U.S. Cl. ..... 166/382; 166/207; 166/206; 166/217

(58) Field of Classification Search ..... 166/380, 166/297, 215, 217, 206, 207, 382
See application file for complete search history.

(56) References Cited

U.S. PATENT DOCUMENTS 556,718 A 3/1896 Semmer
2,877,822 A 3/1959 Buck
3,354,969 A 11/1967 Ebeling
RE28,449 E 6/1975 Edmond
4,095,655 A 6/1978 Still
5,101,897 A * 4/1992 Leismer et al. ..... 166/217
5,348,095 A 9/1994 Worrall et al.
5,366,012 A 11/1994 Lohbeck
5,667,011 A 9/1997 Gill et al.
5,785,120 A 7/1998 Smalley et al.
5,794,703 A 8/1998 Newman et al.
5,901,789 A 5/1999 Donnelly et al.
5,944,102 A * 8/1999 Kilgore et al. ..... 166/119
5,960,895 A 10/1999 Chevallier et al.
6,012,523 A 1/2000 Campbell et al.
6,021,850 A 2/2000 Wood et al.
6,029,748 A * 2/2000 Forsyth et al. ..... 166/380
6,070,671 A 6/2000 Cumming et al.
6,241,017 B1 * 6/2001 Doane et al. ..... 166/134
6,263,966 B1 7/2001 Haut et al.
6,315,040 B1 11/2001 Donnelly
6,325,148 B1 12/2001 Trahan et al.

(Continued)

FOREIGN PATENT DOCUMENTS

GB 2370301 A 6/2002

(Continued)

*Primary Examiner*—David Bagnell
*Assistant Examiner*—Shane Bomar
(74) *Attorney, Agent, or Firm*—Steve Rosenblatt

(57) ABSTRACT

A one trip system for expanding a tubular that is solid or perforated or a screen comprises a downhole assembly that features a hydraulic anchor that can be set, released and repositioned to repeat the process. The anchor is small enough to go through the tubular or screen after initial expansion. The anchor's maximum extension is designed to avoid overstressing the already expanded tubular or screen. An expansion tool is hydraulically driven with the initial portion of the stroke delivering an enhanced force. The expansion tool initially supports the tubular or liner but subsequently releases during the first stroke, after the tubular or screen is fully supported.

17 Claims, 9 Drawing Sheets

U.S. PATENT DOCUMENTS

| | | | | |
|---|---|---|---|---|
| 6,668,930 | B1 * | 12/2003 | Hoffman | 166/298 |
| 6,732,806 | B1 * | 5/2004 | Mauldin et al. | 166/382 |
| 6,799,637 | B1 * | 10/2004 | Schetky et al. | 166/384 |
| 2003/0141074 | A1 * | 7/2003 | Freeman | 166/380 |
| 2003/0168222 | A1 * | 9/2003 | Maguire et al. | 166/380 |
| 2003/0188874 | A1 * | 10/2003 | Gabrysch et al. | 166/380 |
| 2004/0216891 | A1 * | 11/2004 | Maguire | 166/380 |
| 2004/0216893 | A1 * | 11/2004 | Hirth | 166/382 |
| 2004/0216894 | A1 * | 11/2004 | Maguire | 166/384 |

FOREIGN PATENT DOCUMENTS

| | | | |
|---|---|---|---|
| WO | WO 00/37771 | | 6/2000 |
| WO | WO 01/18354 | A1 * | 3/2001 |
| WO | WO 01/60545 | A1 | 8/2001 |
| WO | WO 02/090713 | A1 | 11/2002 |

* cited by examiner

METHOD AND APPARATUS FOR ONE TRIP TUBULAR EXPANSION

PRIORITY INFORMATION

This application claims the benefit of U.S. Provisional Application No. 60/362,306 on Mar. 7, 2002.

FIELD OF THE INVENTION

The field of this invention is expansion of tubulars and screens downhole in a single trip into the wellbore.

BACKGROUND OF THE INVENTION

The field of expansion of tubulars has gained in popularity. In early attempts, a tubular segment was collapsed to get it into a piece of casing and then, when in position; the tubular was expanded to its original dimension. This technique was used for casing patches where the tubular to be expanded was of a fairly short length. One example of this technique is U.S. Pat. No. 5,785,120. Other techniques involved hydraulic pressure applied to a swage to force it through a tubular for expansion. One example of this technique is U.S. Pat. No. 6,029,748. A shortcoming of pressure techniques are that they depend on a solid tubular to avoid losing the driving pressure. For this reason, pressure techniques are not suited for slotted liner or screen expansions. Another pressure technique is illustrated in U.S. Pat. Nos. 6,235,148; 5,348,095 and 6,070,671.

Various expandable well screen products have been developed as illustrated in U.S. Pat. Nos. 6,263,966; 5,901,789 and 6,315,040. Bottom up expansion of a slotted liner using a conical swage is illustrated in U.S. Pat. Nos. 5,667,011 and 5,366,012. Roller devices have been used to provide thrust to a swage as shown in U.S. Pat. No. 5,960,895. Weatherford has advertised roller devices for expansion of tubulars to conform to the shape of the borehole. A problem with such a device, particularly when expanding screen is that some portions of the screen get expanded more than others with structural failures being the result.

What is needed and yet not made available by the prior devices or techniques is a way to expand solid tubing, slotted tubing or screen in a single trip while at the same time taking into consideration the need to not overstress the expanded tubular or screen. Equipment that allows the assembly to be run in the hole together and then selectively allows disengagement after support is established downhole, is also a feature of the present invention. An anchor that can be set and released repeatedly and fit into the expanded tubular or screen is also another aspect of the present invention. Yet another aspect is an anchor that is configured to obtain a sufficient grip for driving the swage but is otherwise limited in its axial travel so as to avoid needless stressing of the tubular of screen after it has already been expanded by about 25% or more. These and other features of the invention will be more readily apparent to a person skilled in the art from a review of the description of the preferred embodiment, which appears below.

SUMMARY OF THE INVENTION

A one trip system for expanding a tubular that is solid or perforated or a screen is disclosed. The downhole assembly features a hydraulic anchor that can be set, released and repositioned to repeat the process, is used. The anchor is small enough to go through the tubular or screen after initial expansion. The anchor's maximum extension is designed to avoid overstressing the already expanded tubular or screen. An expansion tool is hydraulically driven with the initial portion of the stroke delivering an enhanced force. The expansion tool initially supports the tubular or liner but subsequently releases during the first stroke, after the tubular or screen is fully supported.

DETAILED DESCRIPTION OF THE DRAWINGS

FIGS. 1*a*–1*c* are a sectional elevation of the assembly showing the anchor, the expansion tool, and the running tool in the run in position;

Figure 6A:
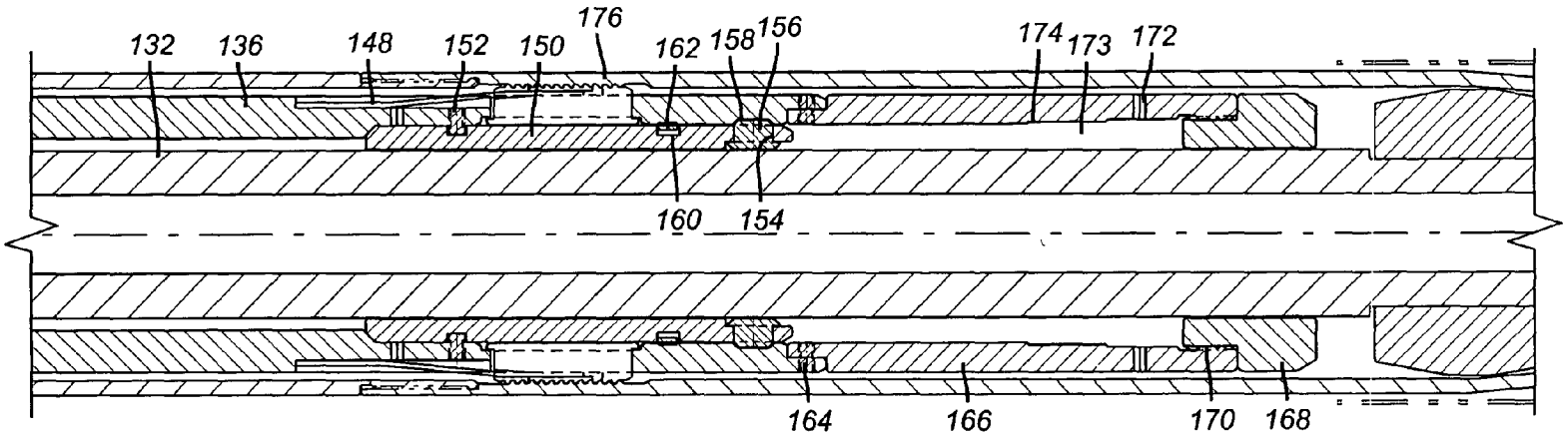
Figure 7A:
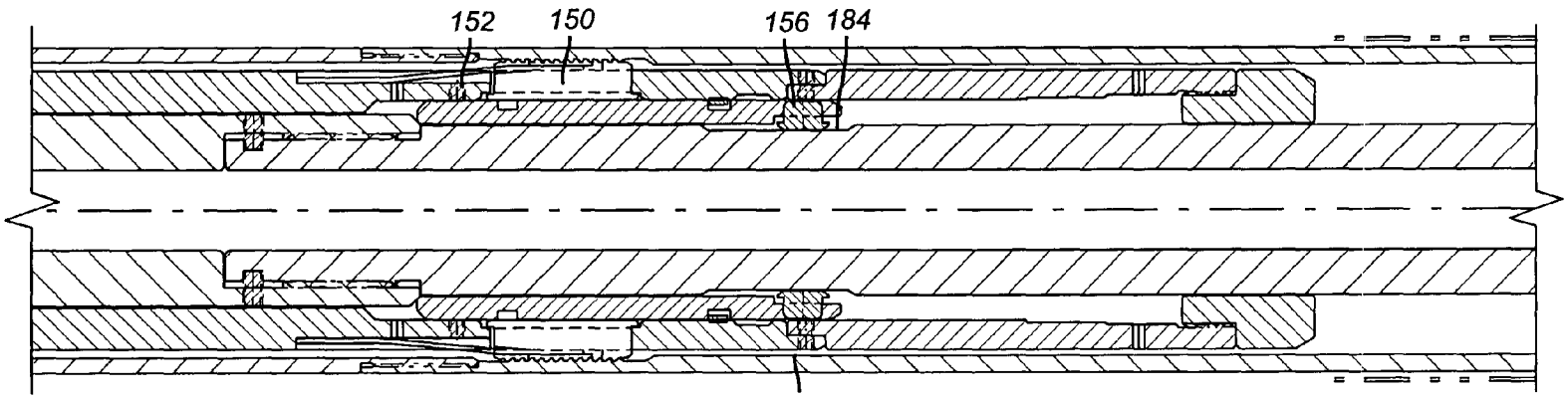
Figure 6B:
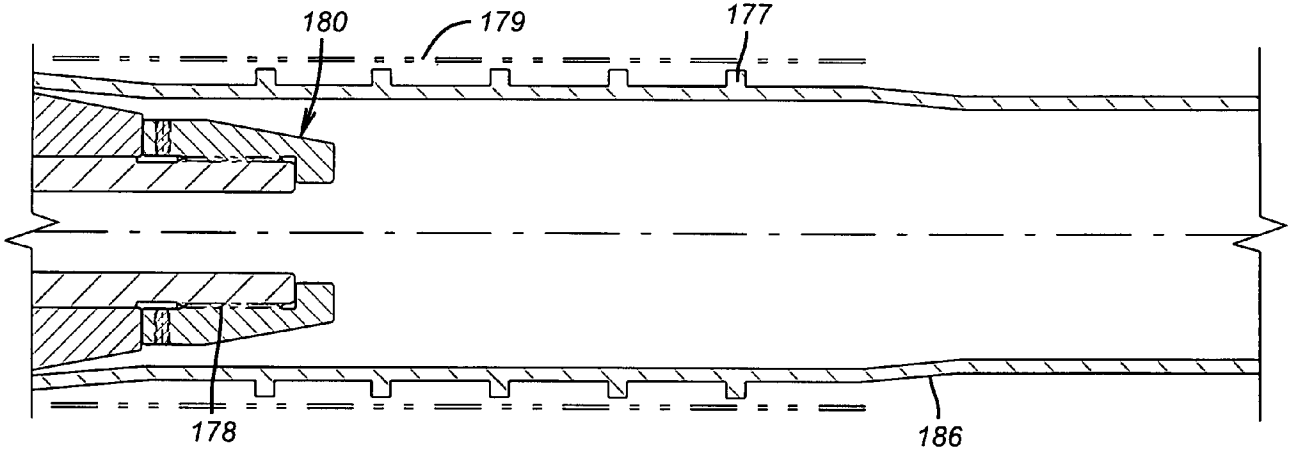
Figure 7B:
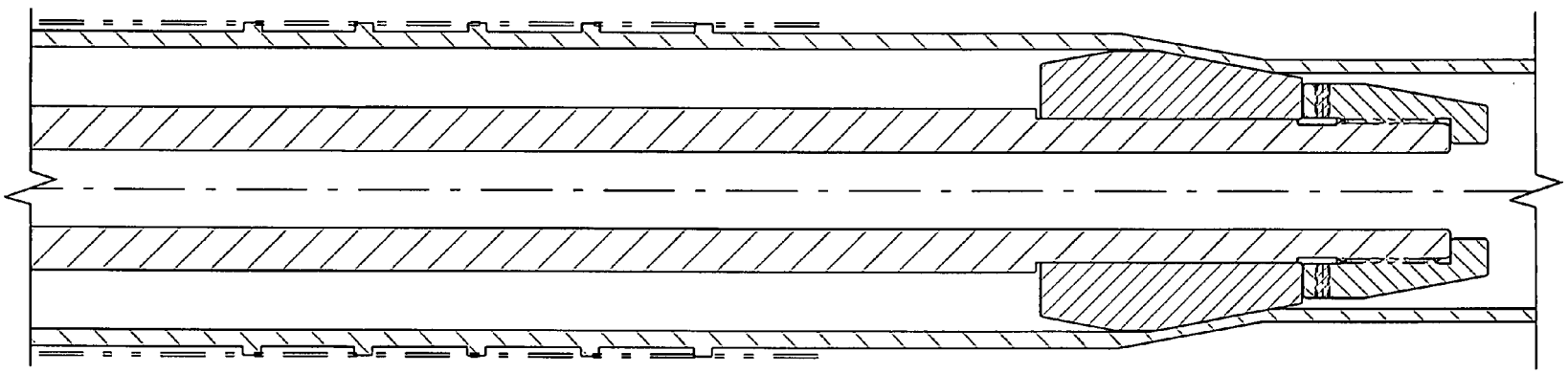
Figure 8A:
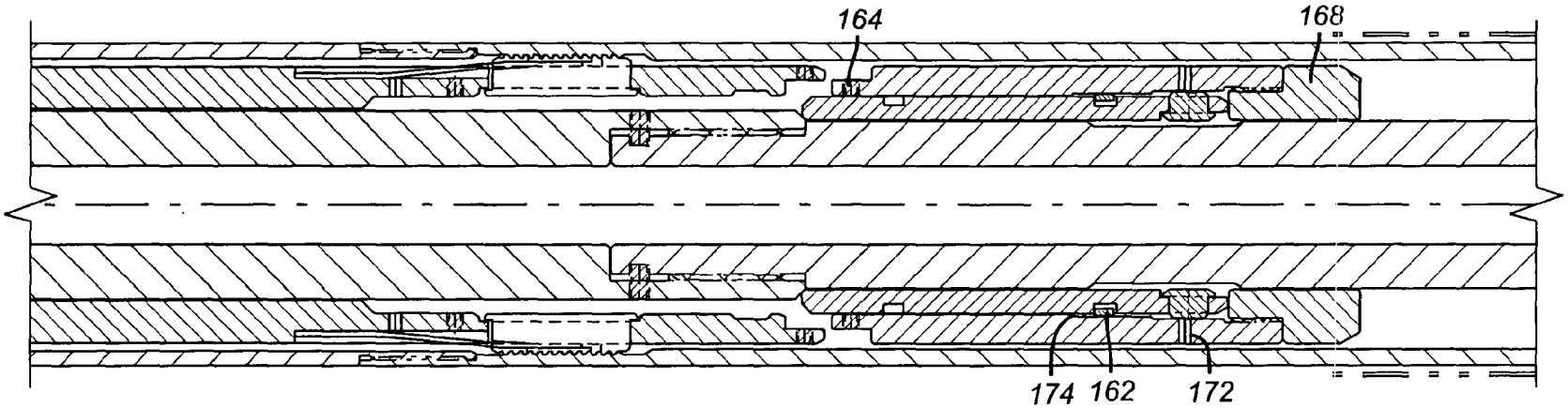
Figure 9A:
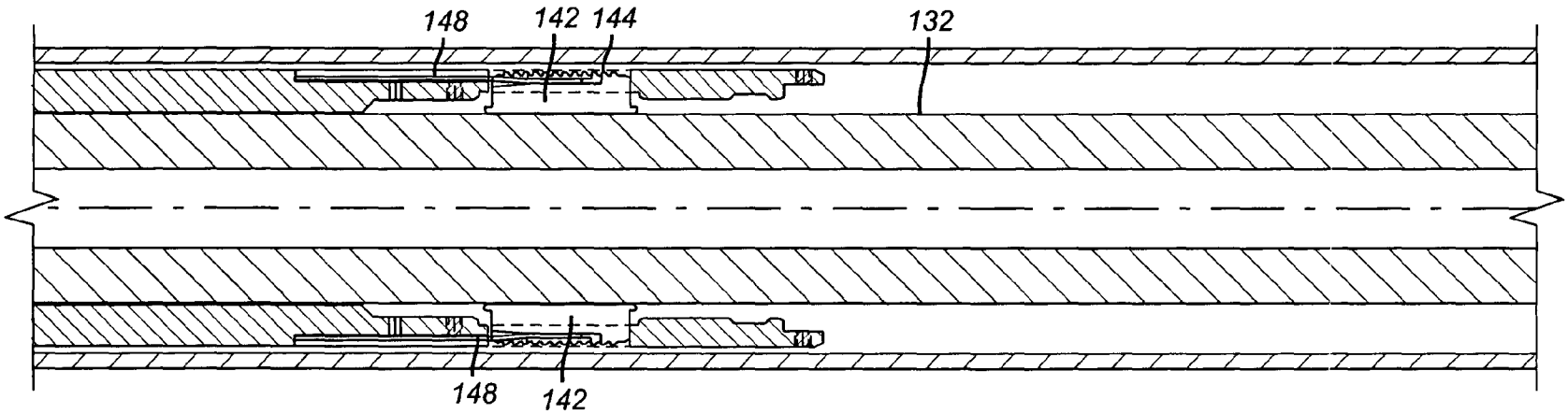
Figure 8B:
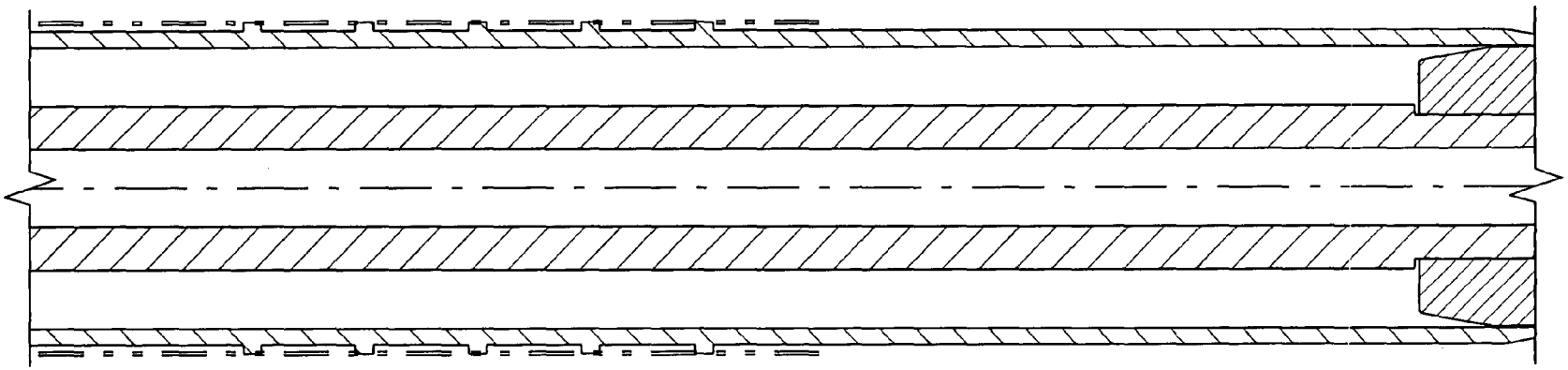
Figure 9B:
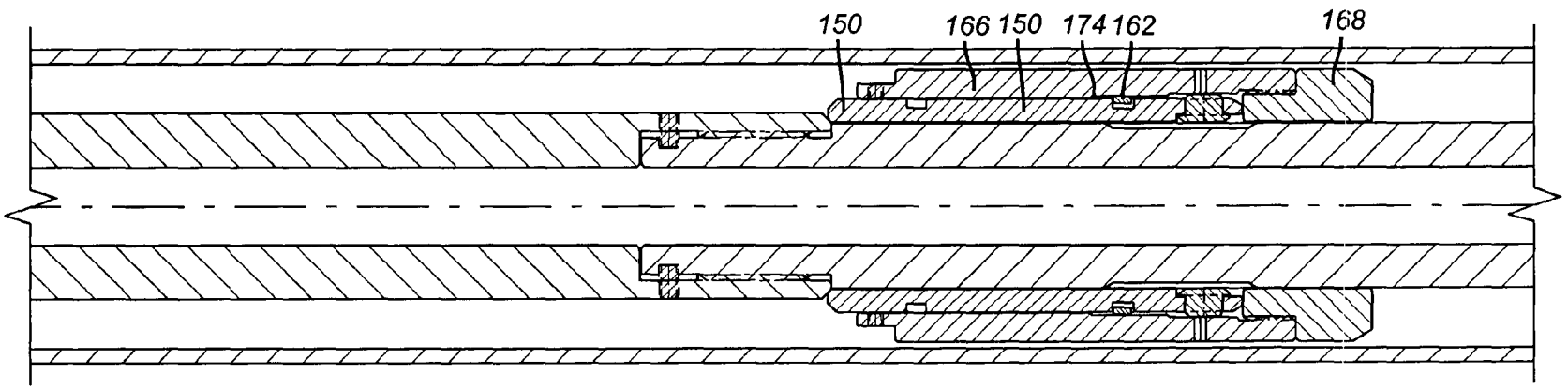

FIGS. 6*a*–6*b* are a section view of a portion of the running tool in the run in position;

FIGS. 7*a*–7*b* show the same portion of the running tool after the beginning of the stroke;

FIGS. 8*a*–8*b* show the position of the running tool after release from the tubular or screen;

FIGS. 9*a*–9*b* show the running tool fully stroked.

DETAILED DESCRIPTION OF THE PREFERRED EMBODIMENT

Figure 1A:
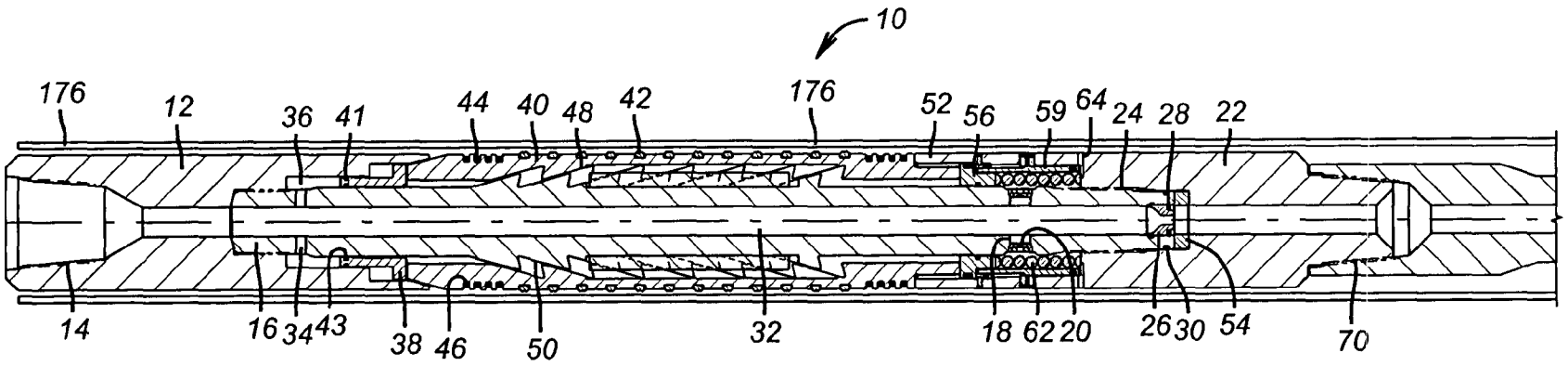
Figure 2:
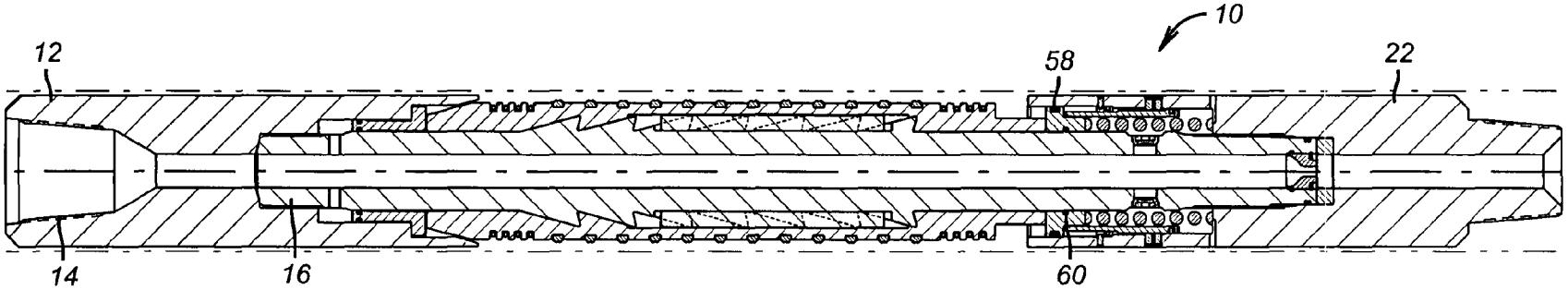
FIG. 2 is a section of the anchor in the run in position.
Figure 3:
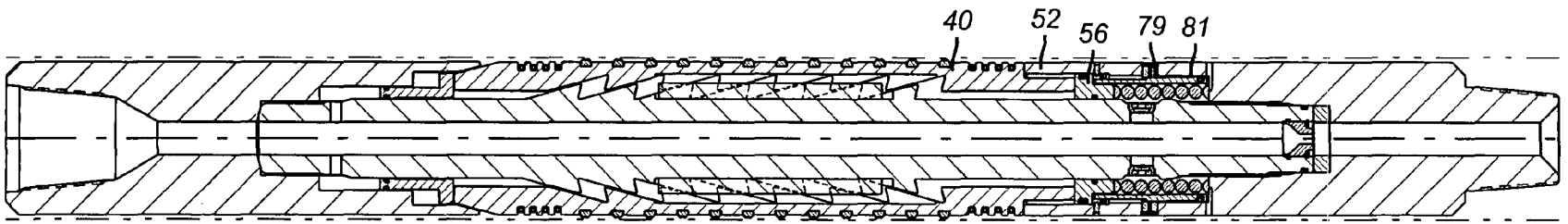
FIG. 3 is a section of the anchor in the set position.
Figure 4:
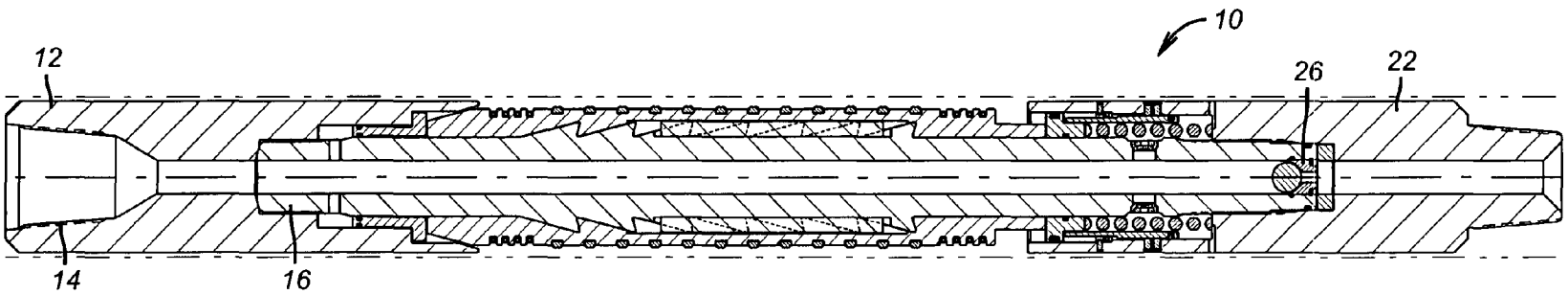
FIG. 4 is a section of the anchor in the emergency release position.
Figure 5:
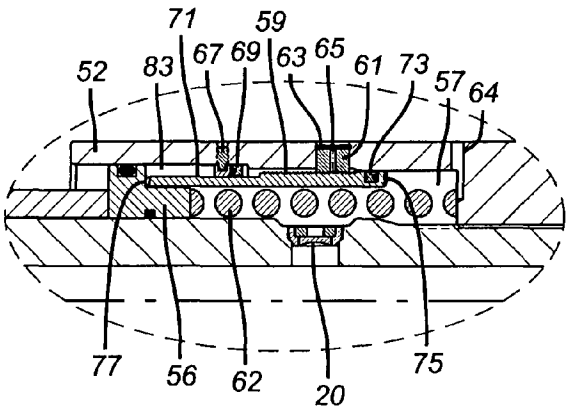
FIG. 5 is a detailed view adjacent the lower end of the slips on the anchor.

Referring to FIGS. 1*a* and 2, the anchor 10 has a top sub 12, which is connected at thread 14 to body 16. A rupture disc 20 closes off a passage 18. At its lower end, the body 16 is connected to bottom sub 22 at thread 24. Body 16 supports a seat 26 with at least one snap ring 28. A seal 30 seals between body 16 and seat 26. The purpose of seat 26 is to receive a ball (not shown) to allow pressure buildup in passage 32 to break rupture disc 20, if necessary. A passage 34 communicates with cavity 36 to allow pressure in passage 32 to reach the piston 38. Seals 41 and 43 retain the pressure in cavity 36 and allow piston 38 to be driven downwardly. Piston 38 bears down on a plurality of gripping slips 40, each of which has a plurality of carbide inserts or equivalent gripping surfaces 42 to bite into the casing or tubular. The slips 40 are held at the top and bottom to body 16 using band springs 44 in grooves 46. The backs of the slips 40 include a series of ramps 48 that ride on ramps 50 on body 16. Downward, and by definition outward movement of the slips 40 is limited by travel stop 52 located at the end of bottom sub 22. FIG. 3 shows the travel stop 52 engaged by slips 40. The thickness of a spacer 54 can be used to adjust the downward and outward travel limit of the slips 40.

Located below the slips 40 is closure piston 56 (see FIGS. 2–5) having seals 58 and 60 and biased by spring 62. A passage 64 allows fluid to escape as spring 62 is compressed when the slips 40 are driven down by pressure in passage 34. Closure piston 56 is located in chamber 57 with ratchet piston 59. A ratchet plug 61 is biased by a spring 63 and has a passage 65 though it. A dog 67 holds a seal 69 in position against surface 71 of ratchet piston 59. A Seal 73 seals between piston 59 and bottom sub 22. Area 75 on piston 59 is greater than area 77 on the opposite end of piston 59. In normal operation, the ratchet piston 59 does not move. It is only when the slips 40 refuse to release and rupture disc 20 is broken, then pressure drives up both pistons 56 and 59 to force the slips 40 to release and the ratchet teeth 79 and 81 engage to prevent downward movement of piston 56. Passage 65 allows fluid to be displaced more rapidly out of chamber 83 as piston 59 is being forced up.

Figure 1B:
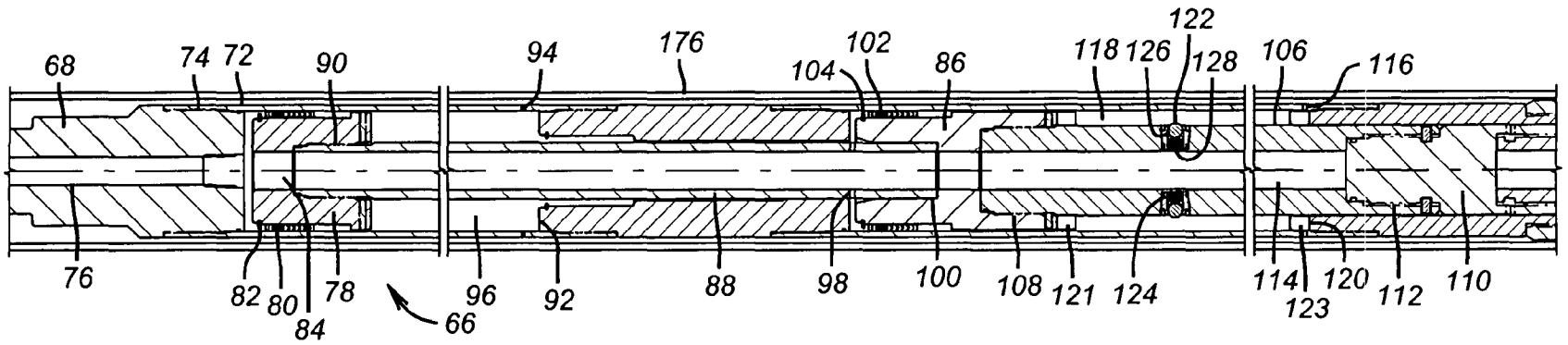
Figure 1C:
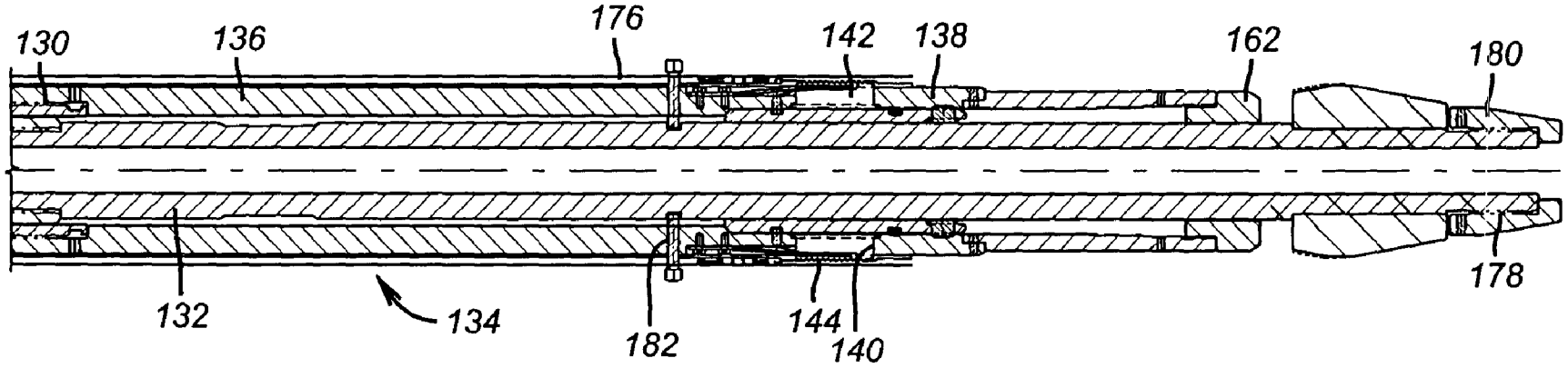

Referring now to FIG. 1*b*, the pressure-magnifying or expansion tool 66 has a top sub 68 connected to bottom sub 22 of anchor 10 at thread 70. A body 72 is connected at thread 74 to top sub 68. A passage 76 in top sub 68 communicated with passage 32 in anchor 10 to pass pressure to upper piston 78. A seal 80 is retained around piston 78 by a snap ring 82. Piston 78 has a passage 84 extending through it to provide fluid communication with lower piston 86 through tube 88 secured to piston 78 at thread 90. Shoulder 92 is a travel stop for piston 78 while passage 94 allows fluid to move in or out of cavity 96 as the piston 78 moves. Tube 88 has an outlet 98 above its lower end 100, which slidably extends into lower piston 86. Piston 86 has a seal 102 held in position by a snap ring 104. Tube 106 is connected at thread 108 to piston 86. A lower sub 110 is connected at thread 112 to tube 106 to effectively close off passage 114. Passage 114 is in fluid communication with passage 76. Passage 116 allows fluid to enter or exit annular space 118 on movements of piston 86. Shoulder 120 on lower sub 110 acts as a travel stop for piston 86. At full stoke, castellations 121 engage castellations 123 to allow torque transmission. A ball 122 is biased by a spring 124 against a seat 126 to seal off passage 128, which extends from passage 114. As piston 86 reaches its travel limit, ball 122 is displaced from seat 126 to allow pressure driving the piston 86 to escape just as it comes near contact with its travel stop 120. Thread 130 allows mandrel 132 of running tool 134 to be connected to pressure magnifying tool 66.

Running tool 134 has a body 136 (see Figs 1*c* and 6–9) having a lower end 138 and adjacent openings 140 through which extend dogs 142, each of which have an exterior thread pattern 144 to mate with thread pattern 146 of the tubular, solid or slotted or a screen, all collectively referred to and defined for the purposes of this application as "tubular" 176. A plurality of leaf springs 148 bias all the dogs radially inwardly when support for the dogs 142 is removed, as shown in FIG. 9.A support sleeve 150 is disposed between body 136 and mandrel 132 and is initially secured with shear pin 152. Openings 154 in sleeve 150 each have a locking dog 156 extending though them and into grooves 158. Mandrel 132 supports locking dogs 156 in their respective grooves 158 for run in, as shown in FIG. 6. A groove 160 holds a snap ring 162 whose purpose will be explained below. Support sleeve housing 166 is retained by shear pin 164 to body 136. End cap 168 is connected at thread 170 to support sleeve housing 166. Passage 172 is a vent for annular space 173. Shoulder 174 on housing 166 eventually retains support sleeve 150 via snap ring 162, as shown in FIG. 9*b*. Threads 178 secure the swage 180, which in the preferred embodiment is of a fixed maximum dimension. It is worth noting that the tubular 176, to be expanded, extends uphole past the anchor 10. This is done so that in the initial anchoring, the slips 40 can obtain a sufficient grip to allow the swage 180 to advance despite the fact that the outward extension of the slips 40 is limited. The limitation of outward movement of the slips 40 insures that on subsequent cycles, when the anchor 10 has advanced into a portion of the tubular 176 that has previously been expanded, the tubular 176 is not further stressed after already having been expanded. Tubular 176 further comprises an exterior surface treatment that is schematically shown as 177 for the purpose of enhancing the grip against the schematically illustrated lowermost wellbore casing 179 from which support will ultimately be provided for the tubular 176.

The operation of the tool in the performance of the service will now be explained. The assembly of the anchor 10, the force magnifying tool 66, the running tool 134, which supports the tubular 176 at teeth 144, and the swage 180 are placed in position in the casing 179. Pressure applied to passage 32 reaches piston 38, pushing it and slips 40 down with respect to body 16. Ramps 48 ride down ramps 50 pushing the slips 40 outwardly against the return force of band springs 44. Inserts 42 bite into the casing or tubing and eventually slips 40 hit their travel stop 52. Piston 56 is moved down against the bias of spring 62. The pressure continues to build up after the slips 40 are set, as shown in FIG.3. The pressure applied in passage 76 of pressure magnification tool 66 forces pistons 78 and 86 to initially move in tandem. This provides a higher initial force to the swage 180, which tapers off after the piston 78 hits travel stop 92. Once the expansion with swage 180 is under way, less force is necessary to maintain its forward movement. The tandem movement of pistons 78 and 86 occurs because pressure passes through passage 84 to passage 98 to act on piston 86. Movement of piston 78 moves tube 88 against piston 86. After piston 78 hits travel stop 92, piston 86 completes its stroke. Near the end of the stroke, ball 122 is displaced from seat 126 removing the available driving force of fluid pressure as piston 86 hits travel stop 120. This is a signal to surface personnel that the stroke is complete and that pressure can be turned off. It is worth noting that during removal of the assembly, piston 86 will assume the fully stroked position and ball 122 will be off of seat 126 so that the string to the surface will drain and will not be pulled wet.

With the pressure removed from the surface, spring 62 returns the slips 40 to their original position by pushing up piston 56. If it fails to do that, a ball (not shown) is dropped on seat 26 and pressure to a high level is applied to rupture the rupture disc 20 so that piston 56 can be forced up with pressure. When piston 56 is forced up so is piston 59 due to the difference in surface areas between surfaces 75 and 77. Ratchet plug 61 is pushed up against spring 63 as fluid is displaced outwardly through passage 65. Ratchet teeth 79 and 81 lock to prevent downward movement of piston 56.

If more tubular 176 needs to be expanded, weight is set down to return the force-magnifying tool 66 to the run in position shown in FIG. 2 and the entire cycle is repeated until the entire section is expanded to the desired diameter with the swage 180.

The initial stroke of the force-magnifying tool 66 features a release of the tubular 176 by the running tool 134, as illustrated in FIGS. 6–9. Initially, during transportation at the surface and prior to running into the well, the mandrel 132 is retained in a retracted position by lock bolts 182 shown in FIG. 1*c*. These bolts 182 are removed before the assembly is run into the well. The running tool 134 supports the tubular 176 for run in by virtue of the engagement of teeth or thread patterns 144 and 146. As previously stated, the tubular 176 extends beyond the slips 40 of the anchor 10 such that the radial travel distance of slips 40 when initially pushing tubular 176 and its exterior surface treatment 177 against the casing 179 results in a firm support for the tubular 176 against the casing 178. As a part of this process, the running tool 134 will have to release its grip on the tubular 176 so that it can be advanced into the tubular to complete the expansion. FIGS. 6–9 illustrate how that happens as the force-magnifying tool 66 begins its initial stroke. During run in, the support sleeve 150 is secured to body 136 by shear pin 152. In that position, the dogs 142 are pushed out against the inward bias of leaf springs 148. There is gripping contact of the tubular 176 by engagement of teeth or thread patterns 144 and 146. Dogs 156 are supported by mandrel 132 in grooves 158. Housing 166 is retained by shear pins 164 to body 136.

FIG. 7 shows what happens during initial movement of mandrel 132. Shear pin 152 breaks. Groove 184 on mandrel 132 comes under dogs 156. Lower sub 110 engages support sleeve 150 driving it down against end cap 168, as shown in FIG. 8. Fluid in annular space 173 is driven out through passage 172. The force on end cap 168 breaks shear pins 164. Snap ring 162 is retained by shoulder 174. The assembly of housing 166 end cap 168 and support sleeve 150 now slide down swage 180. Meantime, dogs 142 are biased inwardly by leaf springs 148 against mandrel 132. This retracts teeth or thread pattern 144 back inside body 136. The tubular is now fully supported from the casing 178 by the expansion of the surface treatment 177 of tubular 176 into the casing 179 and the full release from running tool 134 as described above.

It should be noted that there is a taper 186 on the tubular 176 just below the surface treatment 177. Taper 186 makes it easier to advance the tubular 176 into position where the surface treatment 177, which is on a larger diameter, will be in position to engage the casing 179 for support of tubular 176.

It should again be emphasized that "tubular" as used herein incorporates solid tubes, perforated or slotted tubes, and screens of any construction. The equipment and method described above allow expansion of any desired length even in deviated wellbores where string manipulation is not practical. The anchor 10 and the force-magnifying tool 66 are built to have an outside diameter that will allow them to easily pass into the expanded tubular 176. This eliminates the need for long lengths of tubing to connect a swage 180 to the force-magnifying tool 66, as would be necessary if the anchor 10 and the force-magnifying tool 66 could not pass into the expanded tubular 176. While the use of a fixed diameter swage 180 is described, a swage that can be positioned between or among several dimensions can also be used. The uniformity of expansion obtained by using a swage at a predetermined diameter avoids the potential failure problem due to uneven expansions that can occur using hydraulically actuated rollers that move responsively to the borehole shape. Swages that fix the expansion and insure that the expansion force is uniformly applied are contemplated even if such swages include rollers that are fixed. Yet another beneficial feature is the anchor 10 design. It has limited radial travel so that when energized in already expanded tubular 176 it will not further stress it to failure in trying to get an anchoring grip. The limited outward movement of the slips 40 provides this protection. To compensate for the limited radial movement when the anchor is still in the casing 179, the tubular 176 is run up to past the slips 40 on the anchor 10 so that the limited travel of the slips 40 will be sufficient to get a grip on the casing 179 due to the presence of a portion of the tubular 176 around the slips for at least the initial actuation of the anchor 10 and the stroking of swage 180 for transfer of support of the tubular 176 from the running tool 134 to the casing 179.

The foregoing disclosure and description of the invention are illustrative and explanatory thereof, and various changes in the size, shape and materials, as well as in the details of the illustrated construction, may be made without departing from the spirit of the invention.

We claim:

1. A one trip method for placing and expanding a non-perforated tubular in a cased wellbore comprising:

delivering the non-perforated tubular, by direct support from an assembly comprising at least a running tool, a resetting anchor and a swage to a desired location in a single trip, said direct support during delivering coming from said running tool;

actuating the resetting anchor to initially grip the tubular while said tubular is still at least partially supported by said running tool so as to allow the swage to be initially advanced;

advancing the swage, without initially supporting the tubular against the interior of the wellbore, in a direction from the top of the tubular toward the bottom of the tubular;

releasing the running tool of said assembly from direct support of the tubular, so that it can be removed therefrom, as a result of a predetermined movement of said swage, while in contact with the tubular, sufficient to support the tubular from the cased wellbore.

2. The method of claim 1, comprising:

providing at least one dog having an exterior face treatment to engage the tubular for initial support;

undermining said dog by a predetermined stroke of said swage.

3. The method of claim 1, comprising:

providing an exterior face treatment to the tubular;

forcing said exterior face treatment into contact with the cased wellbore by advancing said swage;

releasing said running tool from the tubular after said exterior face treatment supports the tubular in the cased wellbore.

4. A one trip method for placing and expanding a tubular in a cased wellbore comprising:

delivering the tubular and a swage to a desired location in a single trip;

initially advancing the swage in a direction from the top of the tubular toward the bottom of the tubular without initially supporting the tubular against the interior of the wellbore;

providing an anchor having at least one radially movable slip movable in a plurality of cycles in opposed directions to selectively support the swage as said swage is moved in the tubular;

limiting radial outward movement of said slip so that it will not overstress expanded portions of said tubular.

5. The method of claim 4, comprising:

initially positioning said anchor, prior to swaging, so that said slip is in the tubular.

6. The method of claim 5, comprising:

providing a plurality of slips affording substantially complete circumferential grip into one of said tubular and a sleeve extending from the tubular.

7. The method of claim 4, comprising:

providing a travel stop on said slip to selectively limit its outward radial movement.

8. The method of claim 4, comprising:

driving said slip outwardly under pressure against a bias that retracts said slip.

9. A one trip method for placing and expanding a tubular in a cased wellbore comprising:

delivering the tubular and a swage to a desired location in a single trip;

initially advancing the swage in a direction from the top of the tubular toward the bottom of the tubular without initially supporting the tubular against the interior of the wellbore;

providing an anchor having at least one radially movable slip to selectively support the swage as said swage is moved in the tubular;

limiting radial outward movement of said slip so that it will not overstress expanded portions of said tubular;

initially positioning said anchor, prior to swaging, so that said slip is in the tubular;

setting and releasing said anchor in said tubular multiple times as said swage advances in said tubular.

10. A one trip method for placing and expanding a tubular in a cased wellbore comprising:

delivering the tubular and a swage to a desired location in a single trip;

initially advancing the swage in a direction from the top of the tubular toward the bottom of the tubular without initially supporting the tubular against the interior of the wellbore;

providing an anchor having at least one radially movable slip to selectively support the swage as said swage is moved in the tubular;

limiting radial outward movement of said slip so that it will not overstress expanded portions of said tubular;

driving said slip outwardly under pressure against a bias that retracts said slip;

providing a closure piston on which said bias acts;

selectively allowing pressure in a passage in the body of said anchor to boost the force on said closure piston.

11. A one trip method for placing and expanding a tubular in a cased wellbore comprising:

delivering the tubular and a swage to a desired location in a single trip;

advancing the swage in a direction from the top of the tubular toward the bottom of the tubular;

delivering the tubular and swage on an assembly comprising at least a running tool;

releasing said assembly from the tubular as a result of a predetermined movement of said swage;

providing an anchor having at least one radially movable slip to selectively support the swage as said swage is moved in the tubular;

limiting radial outward movement of said slip so that it will not overstress expanded portions of said tubular;

driving said slip outwardly under pressure against a bias that retracts said slip;

providing a closure piston on which said bias acts;

selectively allowing pressure in a passage in the body of said anchor to boost the force on said closure piston;

using said pressure applied to said closure piston to actuate a lock to hold said slip in a retracted position.

12. A one trip method for placing and expanding a tubular in a cased wellbore comprising:

delivering the tubular and a swage to a desired location in a single trip;

initially advancing the swage in a direction from the top of the tubular toward the bottom of the tubular without initially supporting the tubular against the interior of the wellbore;

providing an anchor having at least one radially movable slip to selectively support the swage as said swage is moved in the tubular;

limiting radial outward movement of said slip so that it will not overstress expanded portions of said tubular;

applying pressure to said anchor to extend said slip;

delivering applied pressure to a pressure intensifier;

applying an enhanced force, at the beginning of a stroke, from said pressure intensifier to said swage to initially secure the tubular to the cased wellbore as compared to subsequent expansion of the tubular during the remainder of the stroke from said pressure intensifier.

13. A one trip method for placing and expanding a tubular in a cased wellbore comprising:

delivering the tubular and a swage to a desired location in a single trip;

advancing the swage in a direction from the top of the tubular toward the bottom of the tubular;

delivering the tubular and swage on an assembly comprising at least a running tool;

releasing said assembly from the tubular as a result of a predetermined movement of said swage;

providing an anchor having at least one radially movable slip to selectively support the swage as said swage is moved in the tubular;

limiting radial outward movement of said slip so that it will not overstress expanded portions of said tubular;

applying pressure to said anchor to extend said slip;

delivering applied pressure to a pressure intensifier;

allowing internal pressure in said pressure intensifier to bleed off, from a selectively operated vent, near the conclusion of its stroke.

14. The method of claim 13, comprising:

using said vent to let well fluids drain as said intensifier is removed from the wellbore.

15. The method of claim 13, comprising:

using a drop in internal pressure from opening of said vent as a surface signal that said pressure intensifier has fully stroked.

16. A one trip method for placing and expanding a tubular in a cased wellbore comprising:

delivering the tubular and a swage to a desired location in a single trip;

initially advancing the swage in a direction from the top of the tubular toward the bottom of the tubular without initially supporting the tubular against the interior of the wellbore;

providing an anchor having at least one radially movable slip to selectively support the swage as said swage is moved in the tubular;

limiting radial outward movement of said slip so that it will not overstress expanded portions of said tubular;

driving said slip outwardly on a plurality of parallel ramps;

limiting movement of said slip down said ramps with a travel stop.

17. A one trip method for placing and expanding a tubular in a cased wellbore comprising:

delivering the tubular and a swage to a desired location in a single trip;

advancing the swage in a direction from the top of the tubular toward the bottom of the tubular;

delivering the tubular and swage on an assembly comprising at least a running tool;

releasing said assembly from the tubular as a result of a predetermined movement of said swage;

providing an anchor having at least one radially movable slip to selectively support the swage as said swage is moved in the tubular;

limiting radial outward movement of said slip so that it will not overstress expanded portions of said tubular;

driving said slip outwardly on a plurality of parallel ramps;

limiting movement of said slip down said ramps with a travel stop;

providing an adjustment of said travel stop;

using the same anchor in a variety of dimensions of cased wellbores due to said adjustment feature of said travel stop.

* * * * *